US008959791B2

(12) United States Patent
Knell

(10) Patent No.: US 8,959,791 B2
(45) Date of Patent: Feb. 24, 2015

(54) APPARATUS FOR FLAT DRYING GARMENTS

(76) Inventor: Terrie A. Knell, Henderson, NV (US)

( * ) Notice: Subject to any disclaimer, the term of this patent is extended or adjusted under 35 U.S.C. 154(b) by 893 days.

(21) Appl. No.: 13/153,315

(22) Filed: Jun. 3, 2011

(65) Prior Publication Data

US 2012/0304481 A1 Dec. 6, 2012

(51) Int. Cl.
*F26B 25/18* (2006.01)
*D06F 57/12* (2006.01)
*F26B 25/16* (2006.01)

(52) U.S. Cl.
CPC ..... *D06F 57/12* (2013.01)
USPC ..... 34/239; 34/240

(58) Field of Classification Search
USPC ..... 34/239, 240
See application file for complete search history.

(56) References Cited

U.S. PATENT DOCUMENTS 1,979,514 A * 11/1934 Wilson ..... 312/114
5,815,961 A * 10/1998 Estes et al. ..... 38/14
5,820,187 A * 10/1998 Ament et al. ..... 296/24.43
6,099,447 A * 8/2000 Ramsaroop ..... 482/127
6,394,724 B1 * 5/2002 Kelly et al. ..... 411/353
7,181,859 B2 * 2/2007 Lai ..... 33/563
7,832,037 B2 * 11/2010 Overton ..... 5/655
2006/0038395 A1 * 2/2006 Anderson-Thompson ..... 281/45
2008/0022551 A1 * 1/2008 Banta et al. ..... 34/602

* cited by examiner

*Primary Examiner* — Kenneth Rinehart
*Assistant Examiner* — Gajanan M Prabhu
(74) *Attorney, Agent, or Firm* — Ariel S. Bentolila; Bay Area IP Group LLC

(57) ABSTRACT

An apparatus includes a canister having a front panel. The front panel has a slit extending across a width of the panel. The canister is operable for being supported from a first vertical surface. A spring-loaded axle is operable for rotating in a first direction to generate a tension sufficient to rotate the axle in a second direction. Caps are joined to the canister for substantially enclosing the axle within the canister. A netting supports wet garments to lay flat. The netting comprises a first end and a second end. The first end is joined to the axle with the second end protruding from the slit. A hem bar is joined to the second end of the netting. Means secures the hem bar to a second vertical surface. A tension knob is joined to the end of the axle and is operable for adjusting a level of the tension.

7 Claims, 2 Drawing Sheets

APPARATUS FOR FLAT DRYING GARMENTS

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to clothing care. More particularly, the invention relates to means for drying clothing.

BACKGROUND OF THE INVENTION

In today's economic circumstances, consumers are being much more cautious and careful with their clothing purchases. However these consumers are buying clothing maintenance products in a much higher volume. Instead of purchasing new clothes, today's consumers are protecting the clothes they already own. Buttons, needles and thread used to mend clothes, stain removers, replacement belt buckles, at-home treatment products for dry-clean-only clothing, and other relevant product fields have enjoyed notable spikes in sales while the general clothing industry itself sits by the wayside. In other words, rather than spending money on clothing, consumers are buying products to protect the clothing they already have and to make their maintenance cheaper and easier.

Many consumers love the look and feel of fashionable fabrics, yet do not care for the trouble involved in their care. Many fashionable fabrics such as, but not limited to, wool, cashmere, and silk require special care when drying. This special care often requires the garment to be dried flat rather than being tumble or line dried. Tumble drying these fabrics can lead to shrinkage or damage. Line drying can cause stretching, creases and wrinkles, and hang drying using clothes hangers can cause shoulder bumps where the hanger contacts the garment. These clothes typically do not hold the same fashionable appearance after improper drying. Too often, special care instructions can make a consumer regret buying new, fashionable clothing because of the inconvenience. If the clothing cannot be tossed into the dryer, many consumers find their appreciation for such clothing to fade.

Proper care of clothing is important. A person's appearance in their clothes is what sets a first impression, and one mere blemish or one sign of improper maintenance of their clothing can negatively affect that first impression. That is why it is important to care for clothing in an appropriate manner. However it can be difficult to do so at times, especially with particular clothing items that require specific care. Items that require flat drying, for example, without limitation, most sweaters, can be tedious to tend to and can also be quite inconvenient to care for in limited space. Flat drying clothing can require a large amount of space, which is often not available in a typical laundry room, and most people do not want to have their clothing spread throughout their house to dry. It is therefore an objective of the present invention to provide means for flat drying clothing.

There are products currently available that are meant to make it easier to care for clothing that requires flat drying, for example, drying racks. However, no matter how easy these products make flat drying, they are not easy to work with. In fact, some of these products can make the whole process more inconvenient. These products are typically large and heavy and must be carried to a place of use. Many of these products must be unfolded and set-up, and then their location of use must be avoided until the clothes are dry. Then, they must be broken down, folded up and carried back to an area large enough to store them.

In view of the foregoing, there is a need for improved techniques for providing means for easily flat drying clothing that is easy to set up and put away and does not require a large amount of space.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a front perspective view. FIG. 1B is a side perspective view. FIG. 1C is a rear perspective view. FIG. 1D is a front perspective view with netting in an extended position. FIG. 1E is a front perspective, partially transparent view, and FIG. 1F is a side perspective view of a netting hem bar attached to a wall;

FIG. 3A is a rear perspective view of the box in a closed position, and FIG. 3B is a front perspective view of the box in an open position.

Figure 1A:
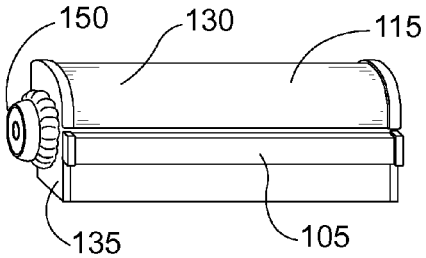
FIGS. 1A through 1F illustrate an exemplary flat drying device, in accordance with an embodiment of the present invention.

Unless otherwise indicated illustrations in the figures are not necessarily drawn to scale.

SUMMARY OF THE INVENTION

To achieve the forgoing and other objects and in accordance with the purpose of the invention, an apparatus for flat drying garments is presented.

In one embodiment an apparatus includes a canister comprising a rear wall, a bottom and a curved front panel. The curved front panel has a horizontal slit extending across a width of the front panel. The canister is operable for being supported from a first vertical surface. A spring-loaded axle is operable for being rotated in a first direction from a first position to a second position to generate a tension sufficient to rotate the spring-loaded axle in a second direction from the second position to the first position. End caps are joined to the canister for substantially enclosing the spring-loaded axle within the canister. One of the two end caps has an opening for enabling an end of the spring-loaded axle to protrude outside of the canister. A netting supports wet garments to lay flat for drying. The netting comprises a netting width, a length, a first end, a second end. The first end is joined to the spring-loaded axle and the netting is rolled about the spring-loaded axle with the second end protruding from the horizontal slit. A hem bar is joined to the second end of the netting. Means removably secures the hem bar to a second vertical surface opposing the first vertical surface where the netting is operable for supporting wet garments to lay flat for drying. A tension knob is joined to the end of the spring-loaded axle protruding outside of the canister. The tension knob is operable for adjusting a level of the tension with the wet garments laying flat on the netting.

In another embodiment an apparatus includes means for housing a portion of the apparatus. The housing means is operable for mitigating pooling of moisture and for being supported on a first vertical surface. Means rotates in a first direction from a first position to a second position to generate a tension sufficient to rotate the rotating means in a second direction from the second position to the first position. Means encloses the rotating means in the housing means. Means supports wet garments to lay flat for drying. The supporting means is joined to the rotating means and protrudes from the housing means. Means mitigates a full retraction of the supporting means into the housing means. The mitigating means is joined to the supporting means. Means secures the mitigating means to a second vertical surface opposing the first vertical surface. Means adjusts a level of the tension with the mitigating means being secured proximate the second vertical surface, the rotating means being at the second position and the wet garments laying flat on the supporting means. The adjusting means is joined to the rotating means.

In another embodiment an apparatus includes a canister comprising a flat rear wall, a flat bottom and a curved front panel. The curved front panel has a shape operable for mitigating pooling of moisture and having a horizontal slit extending across a width of the front panel. The flat rear wall has hosting apertures operable for supporting the canister upon screws that project from a first vertical surface. A spring-loaded axle comprises a length larger than the width of the front panel. The spring-loaded axle is operable for being rotated in a first direction from a first position to a second position to generate a tension sufficient to rotate the spring-loaded axle in a second direction from the second position to the first position. Two end caps are each joined to an end of the flat rear wall, flat bottom and curved front panel to substantially enclose the spring-loaded axle within the canister. One of the two end caps has an opening for enabling an end of the spring-loaded axle to protrude outside of the canister. A netting supports wet garments to lay flat for drying. The netting comprises a netting width, a length, a first end, a second end, reinforced edges, and a waterproof coating. The netting width is less than the width of the front panel. The first end is joined to the spring-loaded axle and the netting is rolled about the spring-loaded axle with the second end protruding from the horizontal slit. A hem bar is joined to the second end of the netting. The hem bar comprises dimensions sufficient to mitigate a full retraction of the netting into the canister. The hem bar further comprises two apertures extending through the hem bar with each aperture being proximate a lateral end of the hem bar. Two hook structures are configured for securing to a second vertical surface opposing the first vertical surface at a distance less than the length of the netting. The two hook structures are further configured for removably passing through the two apertures of the hem bar to secure the hem bar proximate the second vertical surface where the netting is operable for supporting wet garments to lay flat for drying. A tension knob is joined to the end of the spring-loaded axle protruding outside of the canister. The tension knob comprises an ergonomic grip system comprising bumps and valleys for user gripping. The tension knob is operable for adjusting a level of the tension with the hem bar being secured proximate the second vertical surface, the spring-loaded axle being at the second position and the wet garments laying flat on the netting.

Other features, advantages, and objects of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

A preferred embodiment of the present invention and at least one variation thereof provide convenient and space-saving means for drying clothes that cannot be or are preferably not tumble or hang dried. Many preferred embodiments comprise a retractable sheet of netting that can be withdrawn from a canister upon which clothing can be laid flat for drying. Many preferred embodiments may be mounted upon a wall or other plane so that, when not in use, the drying means does not occupy a large amount of space. Many preferred embodiments can accommodate the growing number of consumers who refrain from clothes dryer use due to potential damage upon clothing, utility costs and environmental reasons. Many preferred embodiments of the present invention can encourage consumers to properly care for their clothing and can help consumers generally prevent common damages to their clothing.

Figure 1B:
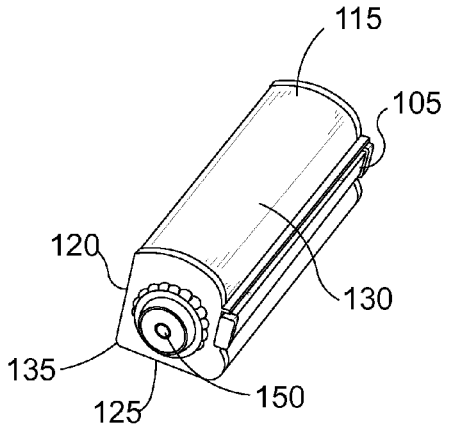
Figure 1C:
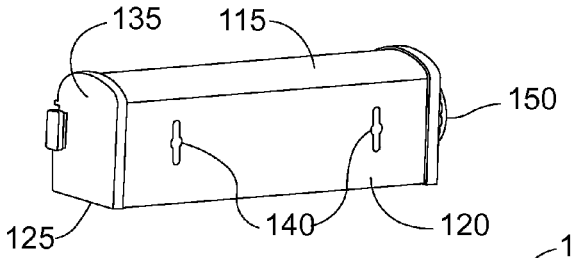
Figure 1D:
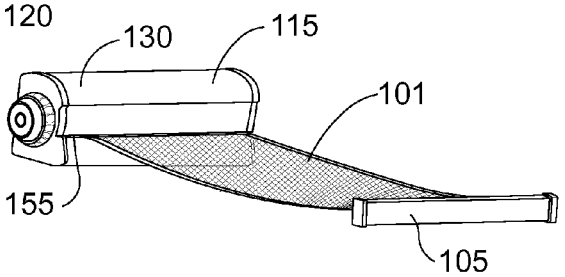
Figure 1E:
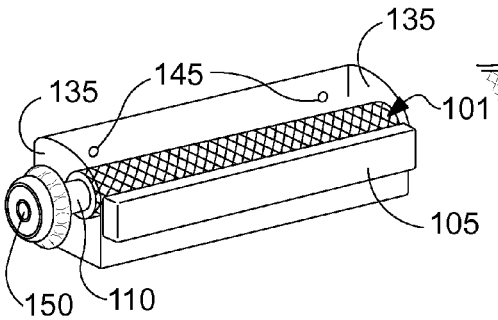
Figure 1F:
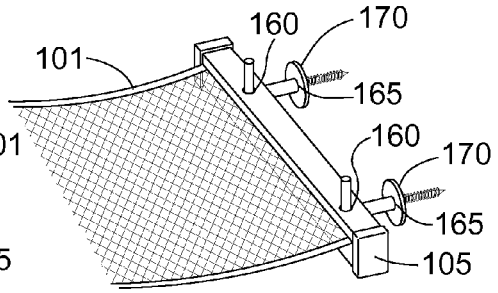

FIGS. 1A through 1F illustrate an exemplary flat drying device, in accordance with an embodiment of the present invention. FIG. 1A is a front perspective view. FIG. 1B is a side perspective view. FIG. 1C is a rear perspective view. FIG. 1D is a front perspective view with netting 101 in an extended position. FIG. 1E is a front perspective, partially transparent view, and FIG. 1F is a side perspective view of a netting hem bar 105 attached to a wall. In the present embodiment the drying device comprises netting 101, a spring-loaded axle 110 for the hosting of netting 101, and a canister 115 which hosts spring-loaded axle 110. Canister 115 is preferably produced of lightweight aluminum, and measures approximately twenty-seven inches in length by three inches in depth (27"× 3"). Canister 115 comprises a flat rear wall 120, a flat bottom 125, and a curved front panel 130 that are enclosed by end caps 135. End caps 135 are preferably produced of high-density polyethylene (HDPE). The shape of canister 115 generally ensures that moisture slides off the device and does not pool on the device, which can increase the life and attractiveness of the device. In alternate embodiments, the canister can be made in various lengths and widths. For example, without limitation, some embodiments may comprise larger canisters for use in professional applications such as, but not limited to, for a dry cleaner or a Laundromat. Furthermore, it is contemplated that the canisters in some alternate embodiments may have various different shapes such as, but not limited to, square or rectangular tubes or cylinders. Yet other alternate embodiments may be implemented without a canister in order to provide an even more space-saving design. In the present embodiment canister 115 is completely enclosed. This seals spring-loaded axle 110 within canister 115 and generally prevents a person's fingers or clothing from getting caught in spring-loaded axle 115. Also, keeping interior components completely encased within canister 115 protects these components which can result in longer life.

Referring to FIGS. 1C and 1E, rear wall 120 of canister 115 has a flat plane, and upon each lateral side of rear wall 120 are hosting apertures 140 for support of the device upon screws 145 that slightly project from a wall or other vertical surface. Referring to FIG. 1E, within canister 115, spring-loaded axle 110 of an approximate one and one-half inch (1½") diameter extends from one end cap 135 of canister 115 for approximately one inch (1"). The extending portion of spring-loaded axle 115 is encased within an ergonomically styled tension knob 150 preferably produced of high-density polyethylene (HDPE). Tension knob 150 enables a user to adjust the tension of netting 101 when the device is in use. Tension knob 150 has a specially designed, ergonomic grip system comprising bumps and valleys to generally ensure that users can easily grip tension knob 150 and turn it, even when their hands are moist. The bumps enable a user to insert their fingertips into the valleys between the bumps so it is difficult for the fingers to slip or fall out of place even if the fingers are moist due to water, detergent, fabric softener, etc. Those skilled in the art, in light of the teachings of the present invention, will readily recognize that a multiplicity of suitable ergonomic designs may be used for the tension knobs in alternate embodiments such as, but not limited to, textured, grooved or ribbed surfaces; however, these designs may not be optimal as these textured surfaces may become filled with moisture, fabric softener or other residue and become slick. In some alternate embodiments, the tension knob may include a rubberized coating for added grip.

Referring to FIGS. 1E and 1F, mounted upon spring-loaded axle 110 is netting 101 that is preferably made of a nylon-polyester blend material with a waterproof coating that measures approximately six feet in length by twenty-six inches in width (72"×26"). The waterproof coating protects netting 101 as wet clothes dry on it; however, in alternate embodiments the netting may not include a waterproof coating and may come in different sizes depending on many factors including, but not limited to, the size of the canister or the intended application of the device. In the present embodiment, the outer edges of netting 101 are thicker, making them reinforced. This helps to maintain the condition of netting 101 for an extended length of time. Netting 101 will be rolled up and extended numerous times over its lifetime so the reinforced edges provide longevity and generally prevent fraying of netting 101. The reinforced outer edges also help to support the weight of wet garments that are flat drying on netting 101. Apertures in netting 101 enable moisture to drip from the clothing. Netting 101 can be pulled and kept taught when in use by tension knob 150. Referring to FIG. 1D, netting 101 can be withdrawn and retracted through a horizontal slit 155 featured upon, and running the length of, front panel 130 of canister 115. Slit 155 has a height of approximately one-half of one inch (½") to enable netting 101 to easily pass through slit 155. Additionally, there are no impediments near slit 155 to generally prevent friction on netting 101 which in turn generally prevents fraying and increases longevity of netting 101.

Enlarged netting hem bar 105 is featured upon the exterior end of netting 101 for prevention of the full retraction of netting 101 into canister 115. Hem bar 105 is preferably made of high-density polyethylene (HDPE) and has an approximate depth of three-quarters of one inch (¾") and a height of one-half inch (½"). In alternate embodiments, the hem bar can be of various sizes to prevent it from retracting within the canister of the drying device. Hem bar 105 can be textured to provide grip to moist hands as the drying device is typically used in a laundry area so most likely a user's hands will be wet from water, detergent, fabric softener, etc. In an alternate embodiment, the hem bar may include a handle to make pulling the netting from the canister easier. In the present embodiment, referring to FIG. 1F, extending through each lateral end of hem bar 105 are two apertures 160 for the hosting of wall-mounted hooks 165. Hooks 165 pass completely through apertures 160 of hem bar 105 to generally ensure that hem bar 105 is adequately supported and to generally eliminate the risk of hem bar 105 coming off of hooks 165. This design also thoroughly supports netting 101 when it is pulled out from canister 115. Hooks 165 can be screwed into a wall via a threaded shaft projecting from a rear wall 170. In some implementations, rear wall 170 of hooks 165 may feature a slightly protruded rubber liner. This liner is pliable and helps to protect the wall in which hooks 165 are applied. In some embodiments, the hooks can feature small rubber caps that can be slipped on to the tips of the hooks. These caps cover the tips of the hooks to generally prevent items from accidently getting snagged on the hooks and to help hold the netting on the hooks when being loaded with clothing. In alternate embodiments, the hem bar itself may comprise hooks to be attached to various different objects such as, but not limited to, eyelets, other hooks, a bar, knobs, wire shelving, etc. rather than or in addition to apertures for placement on hooks.

Those skilled in the art, in light of the teachings of the present invention, will readily recognize that flat drying devices in alternate embodiments may be produced from a multiplicity of suitable combinations of adequate materials. For example, without limitation, the canister and end caps may be made of various materials such as, but not limited to, high-density polyethylene (HDPE), acrylonitrile butadiene styrene (ABS), various metal materials, etc. The hem bar in alternate embodiments can be made of various materials such as, but not limited to, aluminum, high-density polyethylene (HDPE) and acrylonitrile butadiene styrene (ABS). Furthermore, the netting of the drying device in alternate embodiments can be made of various applicable materials such as, but not limited to, cotton, various plastics, nylon and polyester. In some alternate embodiments the netting may be replaced by a solid sheet of an absorbent material such as, but not limited to, cotton, terry, chamois material, etc.

In the present embodiment, the drying device provides means for flat drying sweaters and other garments to provide a consumer needed accommodation for the care of particular clothing items. It is not just sweaters that need flat drying. Garments that require flat drying may be anything made out of wool, cashmere, silk and several blend combinations. Flat drying may also be recommended for manmade fabrics such as, but not limited to, polyester, rayon and even acetate. This means that the drying device may be used with almost any type of clothing including, but not limited to, sweaters, skirts, hosiery, blouses, delicate undergarments, swimsuits, jeans, etc. The drying device can also accommodate clothing that requires hanging such as, but not limited to, stockings Clothing that requires hanging can be accommodated in at least two ways, as follows, without limitation. The first way is to simply lay the clothing flat upon the netting and allow it to flat dry. All though clothing may state it can be hanged to dry; it can also be laid flat to dry so this product would work perfectly. The second way it to hang the hanger that supports the wet clothing on the reinforced outer edging of the net. The net may be secured in a taut position and the reinforced edging can support the hanger.

Figure 2:
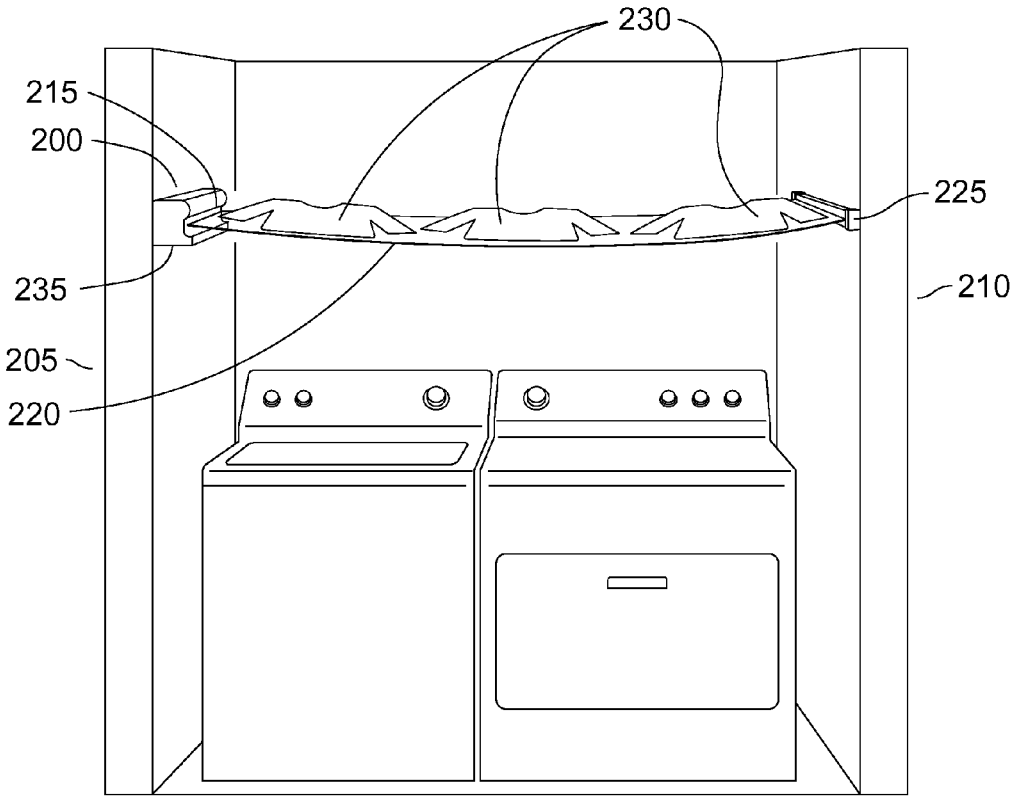
FIG. 2 is a front perspective view of an exemplary flat drying device in use in a laundry room, in accordance with an embodiment of the present invention.

FIG. 2 is a front perspective view of an exemplary flat drying device 200 in use in a laundry room, in accordance with an embodiment of the present invention. In typical use of the present embodiment, a user mounts drying device 200 to a hosting wall 205 using a mounting template on the packaging, as described by way of example in FIGS. 3A and 3B. Using the same template, the user mounts hooks on an opposite wall 210 at the same height as a canister 215. The user then withdraws a netting 220 from canister 215 and mounts a hem bar 225 upon the hooks of opposite wall 210. The user can then lay clothing 230 flat upon netting 220 to dry. If needed, the user may rotate a tension knob 235 attached to a spring-loaded cylinder attached to netting 220 to generally ensure that netting 235 remains taut. By drying clothing 230 flat, drying device 200 does not create noticeable shoulder indentations, like those created by clothing hangers, and does not leave noticeable marks near the hems of clothing, like those created by clothespins. Drying device 200 also enables clothing 230 to dry evenly, unlike hanging methods in which moisture simply declines throughout the structure of the garment. Furthermore, drying device 200 supports clothing 230 throughout the drying process, unlike hanging methods that include a high risk of garments falling upon the floor. When clothing 230 is removed from netting 220, the user may remove hem bar 225 from the hooks to enable netting 220 to retract back within canister 215.

Drying device 200 enables flat drying to be done in a reserved space within the home or other environments. Drying device 200 takes advantage of unused space (i.e., vertical wall space) and satisfies a particular need of persons in small spaces such as, but not limited to, small homes, apartments, dormitories, barracks, and other living quarters. However, drying device 200 can be used in almost any location including, but not limited to, in homes and in businesses. Alternate embodiments can be implemented in formats and sizes for commercial use in businesses such as, but not limited to, hotels, motels, Laundromats, camping grounds, dormitories, and other facilities that offer clothes washing and clothes washing facilities. Some embodiments of the present invention may also be used by drycleaners and laundry service companies. In the present embodiment, drying device 200 is easy to set-up. Unlike other products that require set-up each time use is desired, drying device 200 only requires set-up during its initial installation. By requiring only initial installation, drying device 200 saves time, energy and space that other products require for their set-up, tear down and subsequent storage. In the present embodiment, the screws that mount canister 215 to wall 205 are inserted into wall 205 and the actual canister 215 can be put on the screw heads and removed from the screw heads very easily and quickly. This enables the user to keep canister 215 installed on wall 205 all the time, or the user can remove canister 215 from wall 205 to store drying device 200 somewhere and re-apply it to the screws only when needed. This also enables drying device 200 to be portable so that it can be brought to other locations for use. In alternate embodiments the canister may be permanently mounted to a wall.

Figure 3A:
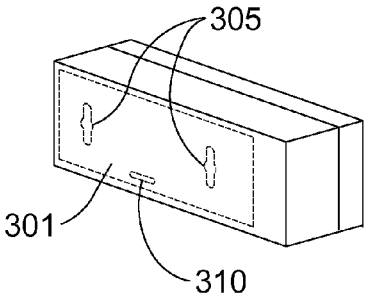
FIGS. 3A and 3B illustrate an exemplary box for a flat drying device, according to an embodiment of the present invention.
Figure 3B:
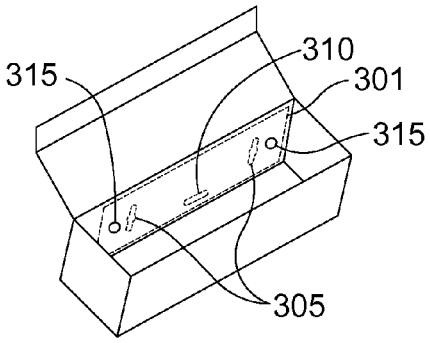

FIGS. 3A and 3B illustrate an exemplary box for a flat drying device, according to an embodiment of the present invention. FIG. 3A is a rear perspective view of the box in a closed position, and FIG. 3B is a front perspective view of the box in an open position. In the present embodiment, the box of the flat drying device comprises a template 301 to generally ensure that the installation of support screws for the drying device is easy and accurate. Template 301 can be used for the simple and accurate installation of the support hooks on the opposite wall as well. The box comprises perforations around template 301 so a user can easily remove template 301 from the box without the use of scissors or any other cutting device. This feature enables the user to use template 301 without having to hold the entire box during product set-up and without needing a cutting utensil. The perforations also generally ensure that template 301 stays in good working condition as it is removed from the box. Positioned on the face of template 301 are three other perforated areas, two screw/hook indicators 305 and a horizontal slit 310. Screw/hook indicators 305 generally ensure that the distance between the screws and hooks is accurate. Horizontal slit 310 is near the bottom center of template 301 and can hold the securing end of a tape measure. The height of the canister of the drying device and the height of the hooks on the opposite wall need to closely match each other. Horizontal slit 310 enables a user to hook a tape measure to slit 310, pull it down to the floor and generally ensure accurate height between the canister and the hooks on the opposite wall. In alternate embodiments the template may not be perforated. In other alternate embodiments, the template may be separate from the box, for example, without limitation, a piece of cardboard or paper included in the box with the drying device. In the present embodiment, the interior face of template 301 features two adhesive areas 315 that are protected by a removable covering that may be made of a thin, removable material such as, but not limited to, wax paper or plastic. Adhesive areas 315 hold template 301 on the wall so the user can have both hands free to complete installation. The adhesive for adhesive areas 305 is hypoallergenic and residue free; therefore, it does not negatively affect users or damage the wall on which it is placed. Some alternate embodiments may not include adhesive areas on the templates.

In typical use of the present embodiment, the user removes template 301 from the box and removes screw/hook indicators 305 and horizontal slit 310. Then, the user removes the coverings from adhesive areas 315 and places template 301 on the installation wall in the approximate area they want the canister and hooks. The user then uses a tape measure to find the desired height, and can adjust the template a few times to achieve the desired placement. Adhesive areas 315 allow for several adjustments before losing their stickiness. The user then marks the location for the screws using screw/hook indicators 305. Once the user has the screws in place for the canister installation, they can remove template 301 and attach it to the opposite wall. The user uses the tape measure to check that the height of template 301 is the same as for the other wall and can then mark and install the hooks. This process typically ensures accurate installation the first time, which can generally prevent errant holes in the wall from the placing of screws in the wrong area. Some alternate embodiments of the present invention may not include an installation template.

In an alternate embodiment of the present invention, the rear wall of the canister is covered with a textured, rubber coating. This rubber coating can help to protect the wall on which the drying device is mounted. When a user extracts or retracts the netting, the canister moves slightly, which may cause the canister to scratch the wall. The rubber coating acts as a buffer to protect the wall. The rubber coating also provides additional grip to help maintain the product in a secure position on the wall.

It is contemplated that alternate embodiments may be implemented with a multiplicity of additional features. For example, without limitation, one alternate embodiment may be implemented with a fan for improving the speed of drying. Some alternate embodiments may include lights, hooks for hanging items, or containers for holding items such as, but not limited to, pocket change, detergent, clothespins, etc. Additionally, alternate embodiments can be produced in various colors, and may or may not bear various images, designs and/or logos, which may or may not be of registered trademark and/or copyright status.

Having fully described at least one embodiment of the present invention, other equivalent or alternative methods of providing means for flat drying clothing according to the present invention will be apparent to those skilled in the art. The invention has been described above by way of illustration, and the specific embodiments disclosed are not intended to limit the invention to the particular forms disclosed. For example, the particular implementation of the drying means may vary depending upon the particular type of mounting method used. The drying means described in the foregoing were directed to wall mounted implementations; however, similar techniques are to provide means for flat drying clothing that are not wall mounted; for example, without limitation, the flat drying device may be placed on a stand or may use suction cups to be removably mounted to a surface such as, but not limited to, tile or a washing machine. Non-wall mounted implementations of the present invention are contemplated as within the scope of the present invention. The invention is thus to cover all modifications, equivalents, and alternatives falling within the spirit and scope of the following claims.

Claim elements and steps herein may have been numbered and/or lettered solely as an aid in readability and understanding. Any such numbering and lettering in itself is not intended to and should not be taken to indicate the ordering of elements and/or steps in the claims.

What is claimed is:

1. An apparatus comprising: a canister comprising a rear wall, a bottom and a curved front panel, said curved front panel having a shape operable for mitigating pooling of moisture and having a generally horizontal slit extending across a width of said front panel, said canister being operable for being supported from a first generally vertical surface; a spring-loaded axle comprising a length larger than a width of said front panel, said spring-loaded axle being operable for being rotated in a first direction from a first position to a second position to generate a tension sufficient to rotate said spring-loaded axle in a second direction from said second position to said first position; two end caps joined to the engaged with said canister for enclosing said spring-loaded axle within said canister, one of said two end caps having an opening for enabling an end of said spring-loaded axle to protrude outside of said canister; a netting for supporting wet garments to substantially lay flat for drying, said netting comprising a netting width, a length, a first end, a second end, said first end being engaged with said spring-loaded axle and said netting being rolled about said spring-loaded axle with said second end protruding from said horizontal slit, wherein said netting width being less than said width of said front panel; a hem bar engaged with said second end of said netting, said hem bar comprising dimensions sufficient to mitigate a full retraction of the netting into said canister, the hem bar further comprising two apertures extending through said hem bar with each aperture being proximate a lateral end of said hem bar; means for removably securing said hem bar to a second generally vertical surface opposing said first vertical surface where said netting is operable for supporting wet garments to substantially lay flat for drying; and a tension knob engaged with said end of the spring-loaded axle protruding outside of said canister, said tension knob comprising an ergonomic grip system comprising bumps and valleys for user gripping, said tension knob being operable for adjusting a level of a tension with said wet garments substantially laying flat on said netting.

2. The apparatus as recited in claim 1, in which said rear wall comprises hosting apertures operable for supporting said canister upon screws that project from said first vertical surface.

3. The apparatus as recited in claim 1, in which said netting further comprises reinforced edges.

4. The apparatus as recited in claim 1, in which said netting further comprises a waterproof coating.

5. The apparatus as recited in claim 1, in which said hem bar comprises dimensions sufficient to mitigate a full retraction of said netting into said canister.

6. An apparatus comprising: means for housing a portion of said apparatus, said housing means being operable for mitigating pooling of moisture and for being supported on a first generally vertical surface; means for rotating in a first direction from a first position to a second position to generate a tension sufficient to rotate said rotating means in a second direction from said second position to said first position; means for enclosing said rotating means in said housing means; means for supporting wet garments to lay flat for drying, said supporting means being engaged with said rotating means and protruding from said housing means; means for mitigating a full retraction of said supporting means into said housing means, said mitigating means being engaged with said supporting means; means for removably securing said mitigating means to a second generally vertical surface opposing said first vertical surface; and means for adjusting a level of a tension with said mitigating means being secured proximate said second vertical surface, said rotating means being at said second position and said wet garments laying flat on said supporting means, said adjusting means being joined to the engaged with said rotating means.

7. An apparatus comprising: a canister comprising a flat rear wall, a flat bottom and a curved front panel, said curved front panel having a shape operable for mitigating pooling of moisture and having a generally horizontal slit extending across a width of said curved front panel, said flat rear wall having hosting apertures operable for supporting said canister upon screws that project from a first generally vertical surface; a spring-loaded axle comprising a length larger than a width of said front panel, said spring-loaded axle being operable for being rotated in a first direction from a first position to a second position to generate a tension sufficient to rotate said spring-loaded axle in a second direction from said second position to said first position; two end caps each engaged with an end of said flat rear wall, flat bottom and curved front panel to enclose said spring-loaded axle within said canister, one of said two end caps having an opening for enabling an end of said spring-loaded axle to protrude outside of said canister; a netting for supporting wet garments to substantially lay flat for drying, said netting comprising a netting width, a length, a first end, a second end, reinforced edges, and a waterproof coating, said netting width being generally less than said width of said front panel, said first end being engaged with said spring-loaded axle and said netting being rolled about said spring-loaded axle with said second end protruding from said horizontal slit; a hem bar engaged with said second end of said netting, said hem bar comprising dimensions sufficient to mitigate a full retraction of said netting into said canister, said hem bar further comprising two apertures extending through said hem bar with each aperture being proximate a lateral end of said hem bar; two hook structures being configured for securing to a second generally vertical surface opposing said first vertical surface at a distance less than said length of said netting, said two hook structures further being configured for removably passing through said two apertures of said hem bar to secure said hem bar proximate said second vertical surface where said netting is operable for supporting wet garments to substantially lay flat for drying; and a tension knob engaged with said end of said spring-loaded axle protruding outside of said canister, said tension knob comprising an ergonomic grip system comprising bumps and valleys for user gripping, wherein said tension knob being operable for adjusting a level of said tension with said hem bar being secured proximate said second vertical surface, said spring-loaded axle being at said second position and said wet garments substantially laying flat on said netting.

* * * * *